US005285239A

United States Patent [19]

Negoro

[11] Patent Number: 5,285,239

[45] Date of Patent: Feb. 8, 1994

[54] MECHANISM FOR MOVING A PAIR OF SHEET DUST BRUSHES

[75] Inventor: Ikuo Negoro, Sakado, Japan

[73] Assignee: Asahi Kogaku Kogyo Kabushiki Kaisha, Tokyo, Japan

[21] Appl. No.: 514,593

[22] Filed: Apr. 26, 1990

[30] Foreign Application Priority Data

Apr. 27, 1989 [JP] Japan ..... 1-50010
Mar. 12, 1990 [JP] Japan ..... 2-60675

[51] Int. Cl.[5] ..... G03G 21/00

[52] U.S. Cl. ..... 355/200; 355/308; 15/77

[58] Field of Search ..... 355/200, 210, 301, 308, 355/309; 15/256.5, 256.52, 77

[56] References Cited

U.S. PATENT DOCUMENTS 3,266,074 8/1966 Wehr ..... 15/77
4,429,984 2/1984 Kiba et al. .
4,717,937 1/1988 Fukunaga .
4,806,970 2/1989 Nakatomi et al. .
4,890,140 12/1989 Negoro et al. .
5,023,667 6/1991 Negoro et al. .

FOREIGN PATENT DOCUMENTS 0348953 1/1990 European Pat. Off. .
3319490 10/1983 Fed. Rep. of Germany .
3811414 10/1988 Fed. Rep. of Germany .
8706527 11/1987 PCT Int'l Appl. .
255189 7/1926 United Kingdom .
433179 8/1935 United Kingdom .
1244263 8/1971 United Kingdom .

*Primary Examiner*—R. L. Moses
*Attorney, Agent, or Firm*—Sandler Greenblum & Bernstein

[57] ABSTRACT

An opening and closing mechanism is provided in a printing device, such as a printer which utilizes fan-folded print sheet fed between a pair of sheet dust brushes, wherein the mechanism separates the pair of brushes when a cover, panel or so forth is opened. The separation of the pair of brushes makes it easy to set the fan-folded sheet, or to remove jammed sheets since the brushes are separated when the cover, panel or so forth is opened.

9 Claims, 5 Drawing Sheets

MECHANISM FOR MOVING A PAIR OF SHEET DUST BRUSHES

BACKGROUND OF THE INVENTION

The present invention relates to an opening and closing mechanism provided on a device such as a printer utilizing a continuous-form sheet capable of causing a pair of sheet dust brushes, between which the continuous-form sheet is fed, for cleaning sheet dust on the continuous-form sheet, to be brought out of contact from each other.

An image forming apparatus, employing an electrophotographic type printer which prints information on the continuous-form printing sheet which is used for a conventional line printer has been known. In such an apparatus, an electrophotographic method, in which a photosensitive material on a photosensitive drum is exposed to light to form a latent image, a toner image being transferred on a recording sheet in accordance with the formed latent image, and the toner image being fixed by a fixing unit, is employed.

The continuous-form sheet is also called a fan-folded sheet and is folded sheets with feed holes, and hereinafter will be referred to as the fan-folded sheet. The folded portion is perforated so that it can be easily cut.

In this type of electrophotographic printer using the fan-folded sheet, generally an upper member is openably disposed on the main unit, the fan-folded sheet passing therebetween. By opening the upper member, the fan-folded sheet can be set in the printer.

Occasionally, on a surface of the fan-folded sheet, sheet dust, which occurs when the feed holes and perforations are made, may be present. The sheet dust tends to stay at the charger of the transfer section or at the photosensitive drum thereby causing trouble, for example, preventing a transfer operation. To prevent such trouble from occurring, a pair of cylindrical brushes are oppositely disposed in parallel at upper and lower portions of the sheet path. Accordingly, the fan-folded sheet is fed between the pair of sheet dust brushes, on a sheet entrance side, which is closer than the transfer section. By rotating the brushes in the direction opposed to the feed direction of the fan-folded sheet, the sheet dust is removed by the brushes.

However, as described above, since the pair of sheet dust brushes are arranged to be rotated, it is desirable that the brushes be in contact with each other, and both brushes are arranged to be provided on the main unit. Accordingly, when the fan-folded sheet is set, it should be passed between the sheet dust brushes, thereby requiring a very complicated operation. In addition, when the fan-folded sheet is jammed, it is very difficult to remove it.

SUMMARY OF THE INVENTION

It is therefore an object of the present invention is to provide an improved opening and closing mechanism for a pair of sheet dust brushes to automatically separate the pair of sheet dust brushes so as to easily set the fan-folded sheet and remove jammed sheets even if the brushes are provided on the main unit of the printer.

For this purpose, according to the present invention, there is provided an opening and closing mechanism, for moving a pair of sheet dust brushes between a first position, at which the pair of brushes are brought into contact with each other, and second position at which said pair of brushes are brought out of contact out from each other. The mechanism is adapted to be positioned in a device utilizing at least fan-folded sheet arranged to be fed between said pair of sheet dust brushes. The opening and closing mechanism being constituted so as to locate the pair of sheet dust brushes at the second position when a predetermined portion of said device is opened.

DESCRIPTION OF THE ACCOMPANYING DRAWINGS

DESCRIPTION OF THE EMBODIMENTS

Figure 1:
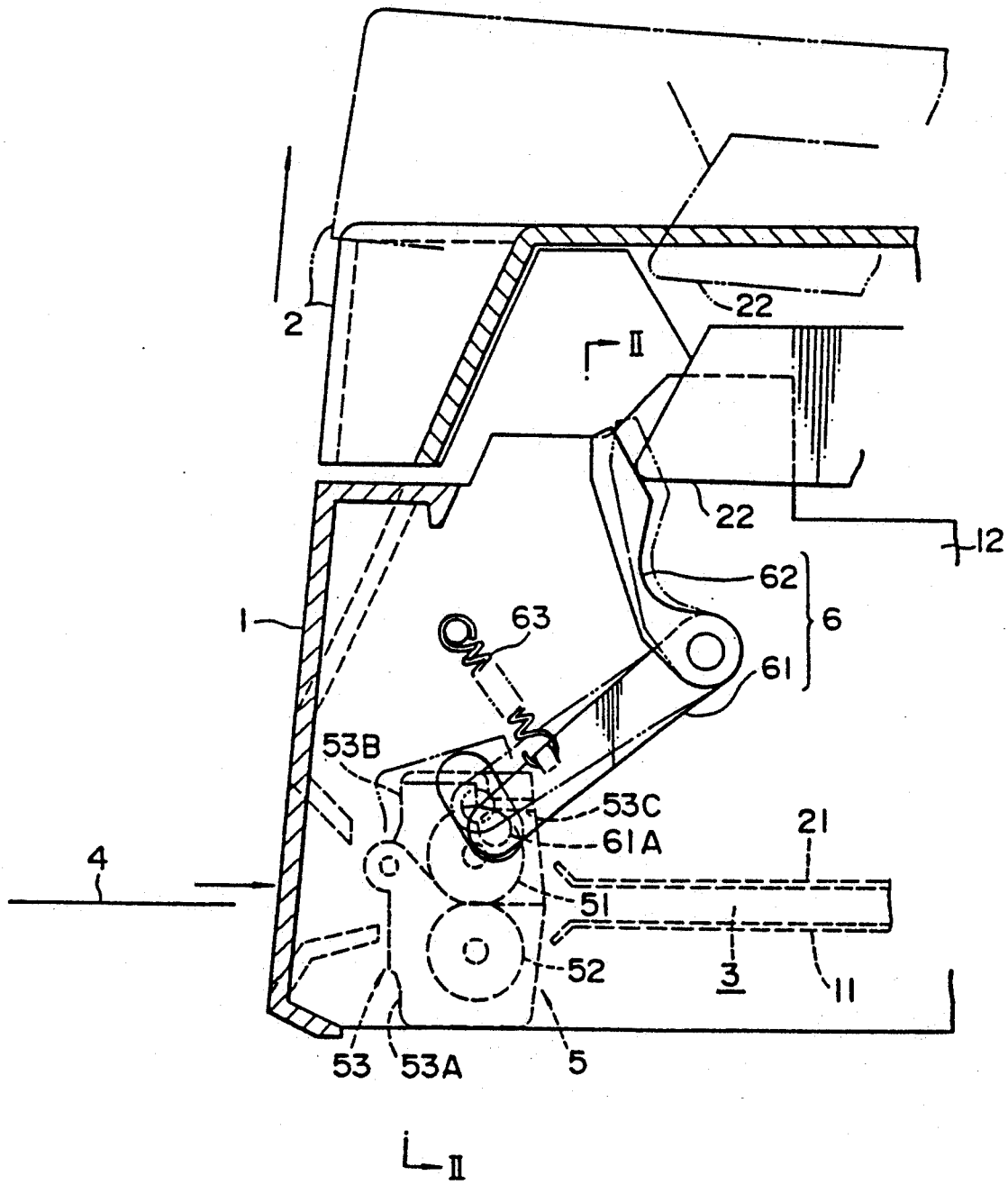
FIG. 1 is an outlined side view of one embodiment of an opening and closing mechanism for a pair of sheet dust brushes according to the present invention.

FIG. 1 is a sectional view near a fan-folded sheet entrance section of a printer using a fan-folded sheet as a recording sheet on which printing operations are executed. The drawing further illustrates a structure of an opening and closing mechanism according to the present invention applied to a pair of sheet dust brushes.

The printer prints data which is input from an external computer and the like on the fanfold sheet using the electrophotographic method. At a main unit 1, a cover 2 which is an upper member, is disposed pivotably openable. The cover 2 is pivotably openable at the end adjacent to the fan-folded sheet entrance side shown in FIG. 1. namely, at the front of the fan-folded sheet feed direction.

A fan-folded sheet feed path 3 is formed between the main unit 1 and the cover 2, a fan-folded sheet 4 being passed along the fan-folded sheet feed path 3. During the period the fan-folded sheet 4 is fed, printing operations are executed thereon and then the fan-folded sheet 4 is discharged.

The fan-folded sheet feed path 3 is structured by a lower guide plate 11 disposed on the upper side of the main unit 1 and an upper guide plate 21 disposed on the lower side of the cover 2, with a predetermined interval.

Near the entrance of the fan-folded sheet feed path 3, a pair of sheet dust brushes 5 are disposed.

Figure 3:
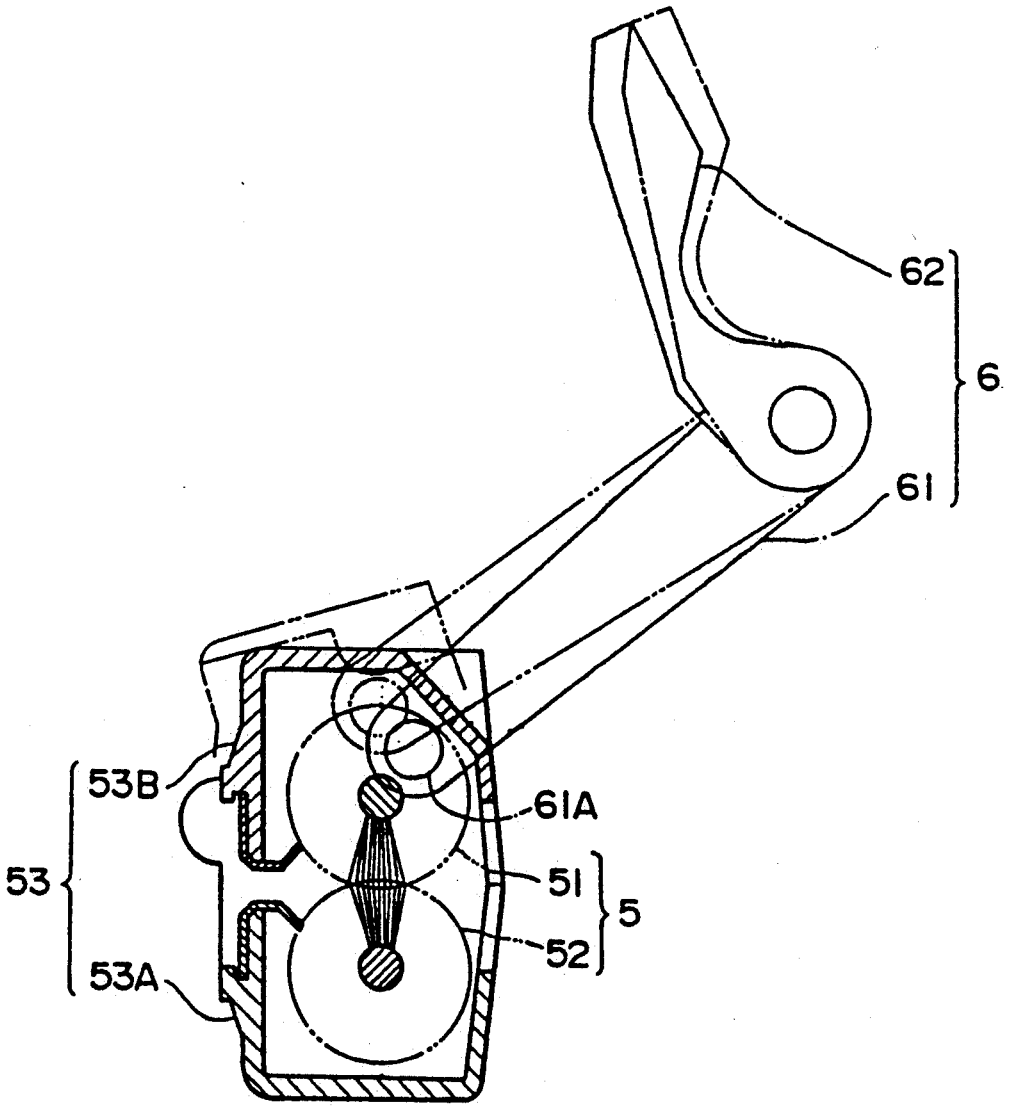
FIG. 3 is a sectional view of the sheet dust brushes employed in the embodiment of FIG. 1.

As shown in FIG. 3, which is a sectional view, the pair of sheet dust brushes 5 are structured with two cylindrical brushes 51 and 52 opposed on the upper and lower sides of a brush holder 53. The fan-folded sheet 4 which is sent to the fan-folded sheet feed path 3 is passed between the brushes 51 and 52, the brush holder 53 being fixed to the main unit 1.

The brush holder 53 is structured with a holder base 53A and a holder arm 53B which is pivotally and rockingly supported thereto on the fan-folded sheet entrance side. A lower brush 52 and a upper brush 51 are disposed on the holder base 53A and the holder arm 53B, respectively, the lengthwise direction thereof according with the breadthwise direction of the fan-folded sheet 4. The lower brush 52 and the upper brush 51 are disposed in the direction perpendicular to the feed direction of the fanfold sheet.

The holder arm 53B is rockingly biased to the holder base 53A by means of a spring, not shown. In the non-tensioned state of the spring, the upper brush 51 is overlapped with the lower brush 52 by a predetermined amount. When the holder arm 53B is upwardly rocked about the pivoting point, the upper brush 51 moves away from the lower brush 52 on the lower side and the upper and lower brush are thereby separated.

Figure 2:
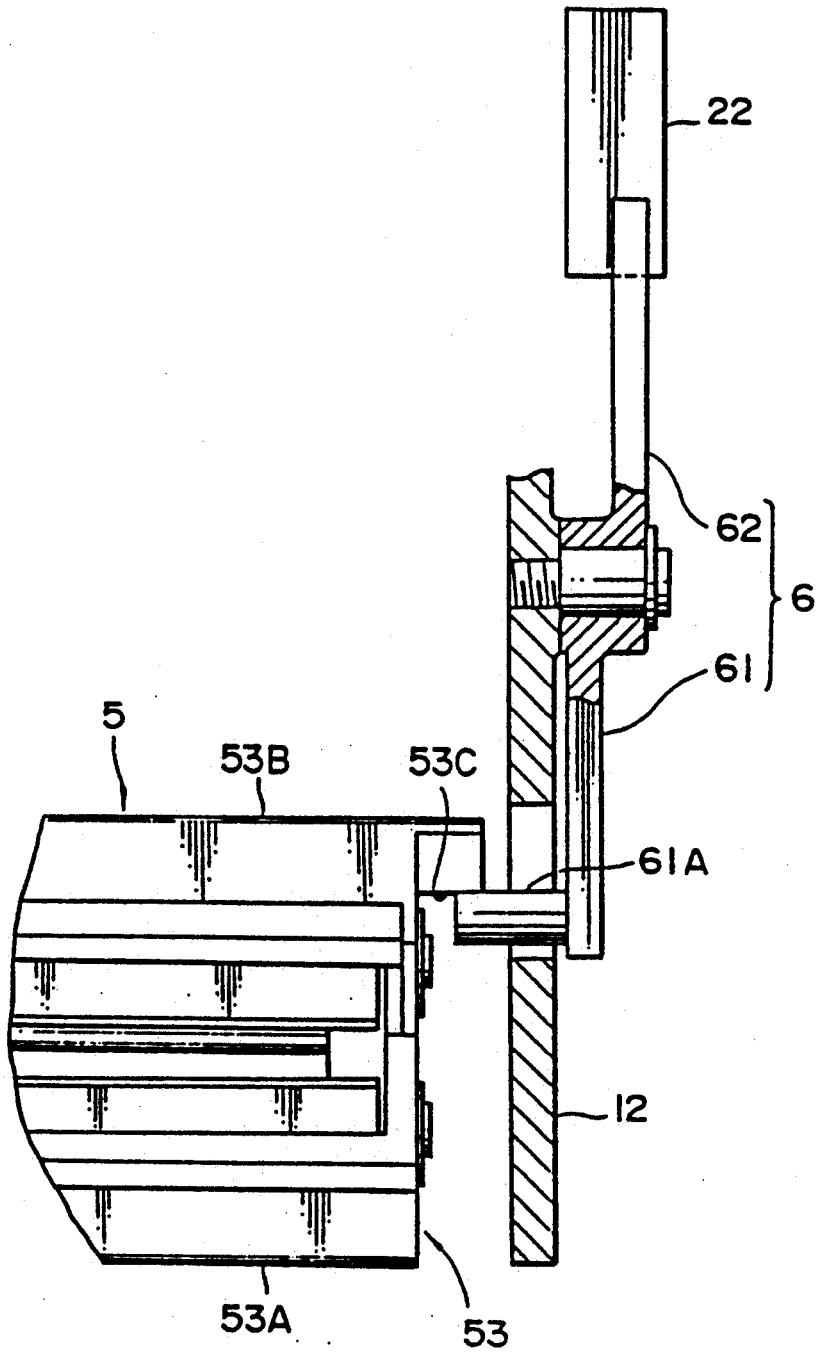
FIG. 2 is a sectional view sectioned along "II—II" line of FIG. 1.

At one end of the holder arm 53B, as shown in FIG. 2, which is a sectional view sectioned along a line "II—II" of FIG. 1, an operation protruded portion 53C where the top portion of the holder arm 53B protrudes sidewise for a predetermined distance is disposed.

The brushes 51 and 52 are individually connected to drive sources through gears, not shown. The upper brush 51 and lower brush 52 are rotatably driven in the reverse direction of the feed direction of the fan-folded sheet 4 in the position where they are opposed, i.e., in a position at which the fan-folded sheet 4 is nipped therebetween. In other words, the upper brush 51 and lower brush 52 are rotatably driven in the reverse direction with each other.

On the upper side of the pair of sheet dust brushes 5, the lever 6 is pivoted to a side plate 12 of the main unit 1.

The lever 6 is formed by operation arm 61 for rocking the holder arm 53B which supports the upper brush 51 and an operation arm 62 which is rockingly driven by the lever operation section 22 of the cover 2 being perpendicularly disposed, the lever 6 being pivoted at the crossed position of operation arms 61 and 62 on the side plate 12 of the main unit 1.

At the end of the brush operation arm 61, a pin 61A is horizontally disposed. A point near the middle of arm 61 is connected to one end of a spring 63 which is fixed to the frame at a position which is over the brush operation arm 61. The lever 6 is rockingly biased by the spring 63 so that the end of the brush operation arm 61 is moved to an upper position.

In the open state, the lever 6 is rockingly tensioned by the spring 63 so that the brush operation arm 61 is rotatably moved to an upper position. The pin 61A at the end of the brush operation arm 61 upwardly contacts the operation protruded portion 53C of the holder arm 53B and thereby the operation protruded portion 53C is pushed up. The holder arm 53B is rocked and then the upper brush 51 moves away from the contacting position with brush 52, as indicated by the two dot lines of FIGS. 1 and 3. In other words, the biasing force of the spring which rockingly biases the holder arm 53B to the holder base 53A side is less than that of the spring 63 which upwardly and rockingly biases the brush operation arm 61.

The lever operation section 22 has a protrusion at an inner position of the cover 2 which corresponds to the operation arm 62 of the lever 6. When the cover 2 is closed, the lever operation section 22 is in contact with the operation arm 62 and thereby the lever 6 is rotated to a predetermined angle in the direction where the brush operation arm 61 is moved to a first position against the biasing force of the spring 63.

When the lever 6 is rotated by the cover 2, the lever 6 is rotated until the pin 61A of the brush operation arm 61 is moved to a position lower than the operation protruded portion 53C of the holder arm 53B when the pin 61A at the end of the brush operation arm 61 is opposed to the lower brush 52. Thus, the pin 61A releases the holder arm 53B and the upper brush 51 is placed in a contact operation position.

Thus, in the printer structured as described above, when the cover 2 is rockingly opened, since the pressure force of the lever 6 by the lever operation section 22 is released, the lever 6 is rotated by a predetermined angular amount by the spring 63, the brush operation arm 61 rockingly raising the holder arm 53B which is held by the brush operation arm 61, and the upper brush 51 upwardly moves away by a predetermined amount. Thus, a predetermined distance between the pair of sheet dust brushes 51 and 52 is created.

Consequently, when setting the fan-folded sheet 4 to the printer or removing a jammed sheet, as the cover 2 is rockingly opened, the pair of sheet dust brushes 5 are automatically opened. Thus, the fan-folded sheet 4 can be easily set and the jammed sheet can be easily removed.

After the fan-fold sheet 4 is set or the jammed sheet is removed, by rockingly closing the cover 2, the lever operation section 22 of the cover 2 causes the lever 6 to rotate against the biasing force of the spring 63 and the upper brush 51 returns to the contact operation position.

In the embodiment described above, the upper brush 51 of the pair of sheet dust brushes 5 is arranged to be moved. However, it is possible to cause the lower brush 52 to move, or both of brushes can be arranged to be moved respectively. In addition, the structure for causing the brush to move away according to the movement of the cover 2 is not necessarily limited to that described in the embodiment. Moveover, the upper brush 51 and lower brush 52 of the pair of sheet dust brushes 5 are described as circular brushes rotatably driven. However, it is also possible to have opposingly dispose conventional brushes where bristles are set onto a plate.

In the above embodiment, the cover 2 is the upper member. By pivotably opening the cover 2, the upper brush 51 on the pair of sheet dust brushes 5 moves away from the contacting position. However, the upper member according to the present invention is not limited to a cover member, i.e., the cover 2 in this embodiment. It is possible to form a member which should be opened when the recording sheet is set in the recording sheet feed path. In other words, as illustrated in FIGS. 4 and 5, as a second embodiment, a front panel 8, provided near the fan-folded sheet entrance section of a printer, is arranged to be rockingly opened, and the pair of sheet dust brushes are arranged to be separated from each other as the front panel is opened.

Figure 4:
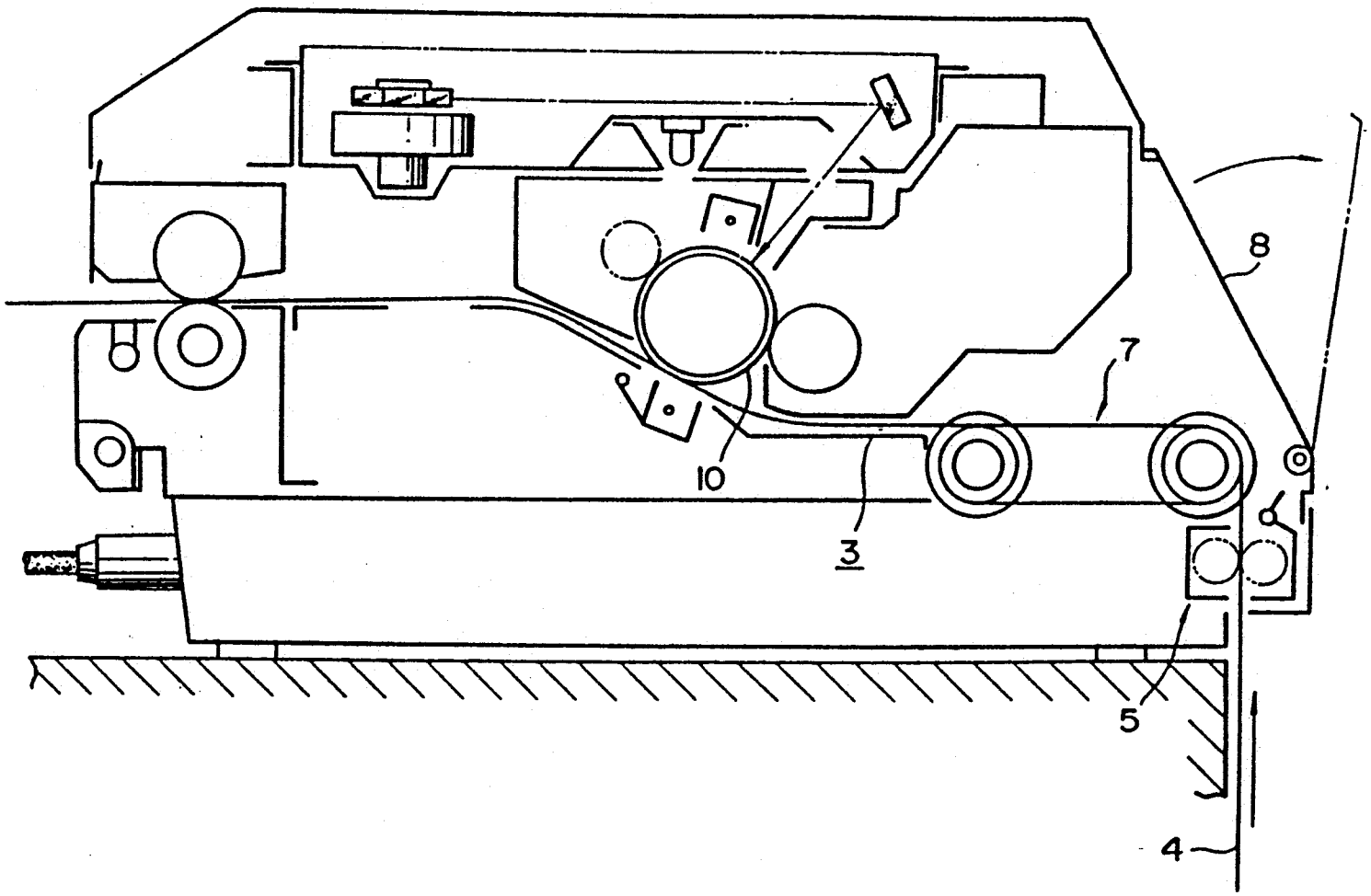
FIG. 4 is an outlined side view of an electrophotographic type printer embodying an opening and closing mechanism according to another embodiment of the present invention.

In the printer of FIG. 4, a tractor belt 7 is provided at the upstream side of a photosensitive drum 10, and at the lower side of the fan-folded sheet feed path 3. Further, the front panel 8 adjacently provided with the tractor belt 7, is arranged to be clockwise and pivotably opened about a lower edge thereof. The fan-folded sheet 4 can be set on the tractor belt 7 after the front panel 8 is opened.

The fan-folded sheet 4 vertically enters into the printer through the fan-folded sheet entrance section provided at the front and lower side of the printer, and is fed by means of the tractor belt 7. As illustrated in FIG. 5, a pair of sheet dust brushes 5 are provided prior to the tractor belt 7 in the fan-folded sheet feed path 3. In this embodiment, the right side in the drawings is the upper side of the fan-folded sheet 4, while the left side is the lower side, the upper brush 51 and the lower brush 52 are respectively provided, at the upper side and the lower side of the fan-folded sheet 4, in a holder base 53A and a holder arm 53B.

Figure 5:
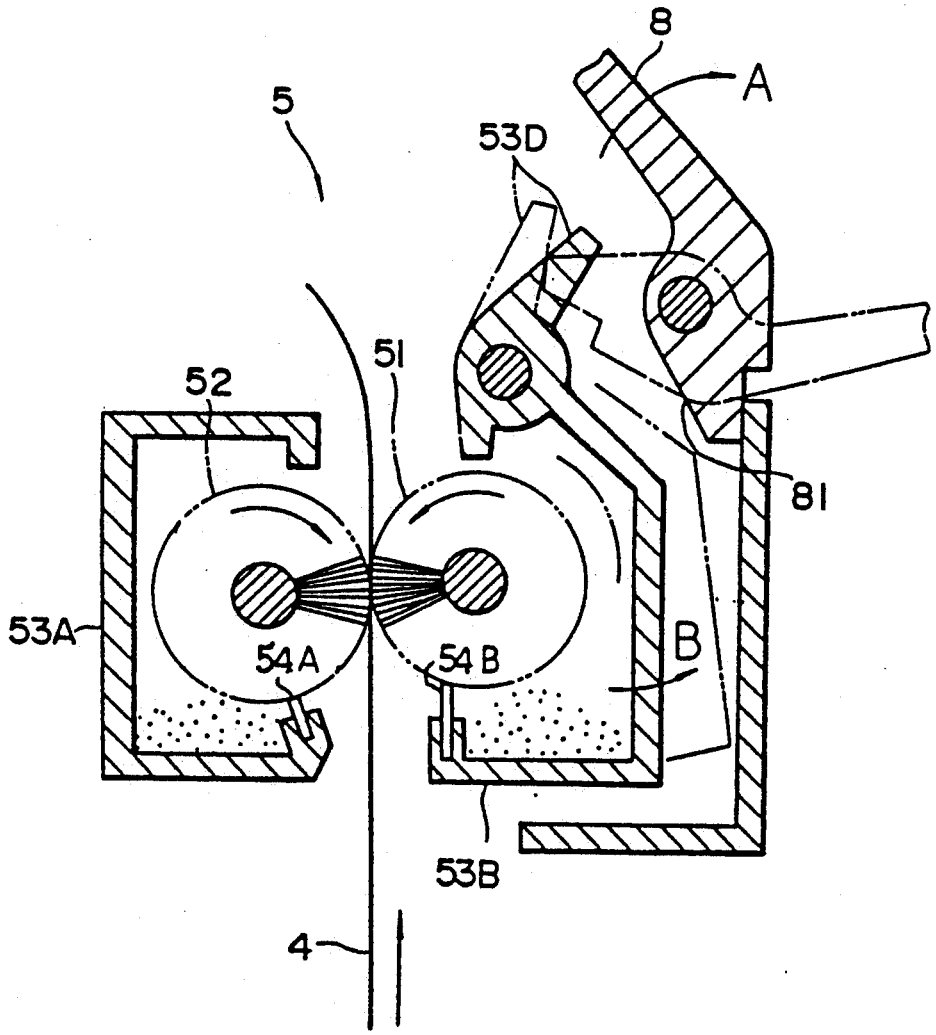
FIG. 5 is a fragmentary sectional view of the opening and closing mechanism of FIG. 4.

The holder arm 53B is rockably supported and an operating projection 53D is obliquely projected as illustrated in FIG. 5. When the operating projection 53D is pushed to the left direction in the drawing, the holder arm 53B is rocked in counterclockwise direction, causing the pair of sheet dust brushes 5 to separate from each other. The holder arm 53B is biased in clockwise direction by means of a spring, which is not shown, in the same manner as the above embodiment illustrated in FIGS. 1 through 3.

In a lower side of the front panel 8, an operating portion 81, arranged to contact the operating projection 53D of the holder arm 53, is provided. When the front panel is opened as illustrated by an arrow "A", the operating portion 81 contacts the projection 53D, causing the holder arm 53B to pivot as illustrated by arrow, and the pair of sheet dust brushes 5 are separated from each other. Further, a pair of blade member 54A and 54B may be respectively provided, to be in contact with the brushes 51 and 52 for peeling off the sheet dust which remains on the brushes 51 and 52 having been cleaned from a surface of the fan-folded sheet 4.

As described above, by employing the pair of sheet dust brushes in an opening and closing mechanism according to the present invention, it is easily possible to set a fan-folded sheet to the printer, and to remove the jammed sheet since the pair of brushes are separated from each other when the upper cover or the front panel is opened.

What is claimed is:

1. An opening and closing mechanism for a sheet printing device comprising:

a pair of sheet dust brushes;

a brush housing including a pair of brush housing portions, said pair of sheet dust brushes each being located in one of said brush housing portions, said pair of brush housing portions being movable between a first position in which said pair of sheet dust brushes are in contact with each other, and a second position in which said pair of sheet dust brushes are separated from each other; and at least one of said brush housing portions being coupled to a predetermined portion of said printing device so as to be movable with respect to said predetermined portion, said predetermined portion being movable between and opened and closed position, said at least one of said brush housing portions being movable to said second position when said predetermined portion is moved to said opened position.

2. The opening and closing mechanism according to claim 1, wherein said predetermined portion comprises an upper cover member of said device.

3. The opening and closing mechanism according to claim 1, wherein said predetermined portion comprises a panel member located adjacent said pair of sheet dust brushes.

4. The opening and closing mechanism according to claim 1, wherein said pair of sheet dust brushes employed in said device are respectively cylindrical-shaped brushes whose central axes are perpendicularly arranged to a direction along which said sheet is fed.

5. The opening and closing mechanism according to claim 4, wherein each of diameter of said cylindrical-shaped brushes are substantially same with each other.

6. The opening and closing mechanism according to claim 4, wherein said cylindrical-shaped brushes are driven to be rotated in opposite directions with each other.

7. The opening and closing mechanism according to claim 1, wherein said device is further provided with a pair of blade members respectively arranged to be in contact with said pair of sheet dust brushes for peeling off sheet dust having been cleaned from said sheet and remaining on said pair of sheet dust brushes.

8. An apparatus for moving a pair of sheet dust brushes between two positions, said apparatus being adapted to be positioned in a device which utilizes at least fan-folded sheet such that said fan-folded sheet is fed between said pair of sheet dust brushes, said apparatus comprising:

means for moving said pair of sheet dust brushes between a first position where said pair of sheet dust brushes are in contact, and a second position where said pair of sheet dust brushes are separated by a predetermined angular distance;

means for biasing said pair of sheet dust brushes toward said first position;

means for biasing said pair of sheet dust brushes toward said second position;

said pair of sheet dust brushes being housed in a brush holder, said brush holder comprising pivotable attached sections, each of said sections housing one sheet dust brush of said pair of sheet dust brushes, said brush holder being biased toward said first position; and said means for moving including a lever assembly, said lever assembly including at least one operation arm with one end in contact with a movable member which moves corresponding to said first position and said second position, and another end in contact with one of said sections of said brush holder, said at least one operation arm being pivotally attached to said device.

9. An apparatus according to claim 8, wherein said device is provided with means for removing sheet dust from said sheet dust brushes, said means for removing sheet dust being in contact with said pair of said sheet dust brushes.

* * * * *

UNITED STATES PATENT AND TRADEMARK OFFICE

CERTIFICATE OF CORRECTION

PATENT NO. : 5,285,239

DATED : February 8, 1994

INVENTOR(S) : I. NEGORO

It is certified that error appears in the above-indentified patent and that said Letters Patent is hereby corrected as shown below:

At column 5, line 49 (claim 1, line 16) of the printed patent, change "and" to ---an---.

Signed and Sealed this

Eighteenth Day of October, 1994

Bruce Lehman

*Attest:*

BRUCE LEHMAN

*Attesting Officer*

*Commissioner of Patents and Trademarks*